US007905321B2

(12) United States Patent
Ballard, III

(10) Patent No.: US 7,905,321 B2
(45) Date of Patent: Mar. 15, 2011

(54) INSERTS FOR ENGINE EXHAUST SYSTEMS

(76) Inventor: Ebbin C. Ballard, III, Myrtle Beach, SC (US)

( * ) Notice: Subject to any disclaimer, the term of this patent is extended or adjusted under 35 U.S.C. 154(b) by 0 days.

(21) Appl. No.: 12/461,957

(22) Filed: Aug. 28, 2009

(65) Prior Publication Data

US 2009/0321181 A1 Dec. 31, 2009

Related U.S. Application Data

(63) Continuation-in-part of application No. 11/705,099, filed on Feb. 12, 2007, now abandoned.

(51) Int. Cl.

| | |
|---|---|
| ***F01N 1/24*** | (2006.01) |
| ***F01N 1/08*** | (2006.01) |
| *F01N 1/00* | (2006.01) |
| *F01N 1/22* | (2006.01) |

(52) U.S. Cl. ..... 181/258; 181/241; 181/252

(58) Field of Classification Search ..... 181/231, 181/233, 241, 258, 267, 256, 252, 264, 283, 181/260

See application file for complete search history.

(56) References Cited

U.S. PATENT DOCUMENTS

| | | | | | |
|---|---|---|---|---|---|
| 199,512 | A | * | 1/1878 | Buzzell | 181/239 |
| 1,666,257 | A | * | 4/1928 | Furnivall et al. | 181/258 |
| 2,185,584 | A | * | 1/1940 | Boyce | 55/517 |
| 2,396,952 | A | * | 3/1946 | Huber | 181/259 |
| 2,477,436 | A | * | 7/1949 | Bannister | 138/26 |
| 2,512,155 | A | * | 6/1950 | Hill | 181/249 |
| 2,548,965 | A | * | 4/1951 | Gaugler | 210/289 |
| 2,943,695 | A | * | 7/1960 | Jeffords | 181/243 |
| 2,990,906 | A | * | 7/1961 | Audette | 181/256 |
| 3,196,977 | A | * | 7/1965 | Sanders | 181/256 |
| 3,292,731 | A | * | 12/1966 | Ballard | 181/227 |
| 3,563,338 | A | * | 2/1971 | Rader | 181/243 |
| 3,602,333 | A | * | 8/1971 | Kobayashi et al. | 181/252 |
| 3,675,398 | A | * | 7/1972 | Giarrizzo | 96/132 |
| 3,677,300 | A | * | 7/1972 | King | 138/42 |
| 3,823,743 | A | * | 7/1974 | King | 138/42 |
| 3,958,967 | A | * | 5/1976 | Nakamura | 55/490 |
| 4,167,986 | A | * | 9/1979 | Conway | 181/224 |
| 4,211,303 | A | * | 7/1980 | Matthews et al. | 181/248 |
| 4,299,305 | A | * | 11/1981 | Eriksson | 181/230 |
| 4,530,418 | A | * | 7/1985 | Currie | 181/227 |
| 4,872,528 | A | * | 10/1989 | Goplen et al. | 181/228 |
| 4,920,746 | A | * | 5/1990 | Gebelius | 60/299 |
| 4,993,512 | A | * | 2/1991 | Lescher | 181/227 |
| 5,007,499 | A | * | 4/1991 | Ebbing et al. | 181/258 |

(Continued)

FOREIGN PATENT DOCUMENTS

GB 2031062 A * 4/1980

(Continued)

*Primary Examiner* — Edgardo San Martin
(74) *Attorney, Agent, or Firm* — Richard C. Litman

(57) ABSTRACT

The insert for an engine exhaust system has at least one conical section of flexible mesh or rovings of metallic or other high temperature resistant fiber or tape. Each section includes a rigid anchor or attachment ring having an outer diameter closely conforming to the inner diameter of the exhaust pipe, with the anchor ring being welded to the mesh or roving or tape material or the mesh or roving or tape being crimped between two concentric rings. A smaller diameter support ring may be provided at the opposite end of the conical mesh, with the support ring braced by a series of radial arms. The device may serve to reduce the sound output of the exhaust system, and/or may serve as a spark arrestor as well.

17 Claims, 6 Drawing Sheets

U.S. PATENT DOCUMENTS

| | | | | | |
|---|---|---|---|---|---|
| 5,371,331 | A | * | 12/1994 | Wall | 181/227 |
| 5,562,126 | A | | 10/1996 | Briand et al. | |
| 5,661,272 | A | * | 8/1997 | Iannetti | 181/256 |
| 5,722,237 | A | * | 3/1998 | Iida et al. | 60/302 |
| 5,824,970 | A | * | 10/1998 | Gracia | 181/228 |
| 5,892,186 | A | * | 4/1999 | Flugger | 181/252 |
| 5,901,754 | A | | 5/1999 | Elsasser | |
| 5,902,970 | A | * | 5/1999 | Ferri | 181/249 |
| 6,116,287 | A | | 9/2000 | Gropp et al. | |
| 6,564,901 | B2 | * | 5/2003 | Woods | 181/235 |
| 6,848,252 | B2 | * | 2/2005 | Maybeck | 60/312 |
| 6,899,198 | B2 | * | 5/2005 | Zindl et al. | 181/222 |
| 7,380,397 | B2 | * | 6/2008 | Chang | 60/324 |
| 2002/0134614 | A1 | * | 9/2002 | Chen | 181/252 |
| 2002/0166719 | A1 | * | 11/2002 | Dooley | 181/228 |
| 2008/0135330 | A1 | * | 6/2008 | Wolf | 181/271 |
| 2008/0190689 | A1 | * | 8/2008 | Ballard | 181/210 |

FOREIGN PATENT DOCUMENTS

| | | | |
|---|---|---|---|
| JP | 6323136 | A | * 11/1994 |

* cited by examiner

INSERTS FOR ENGINE EXHAUST SYSTEMS

CROSS REFERENCE TO RELATED APPLICATIONS

This application is a continuation-in-part of application Ser. No. 11/705,099, entitled "Inserts for Engine Exhaust Systems", filed Feb. 12, 2007, now abandoned.

BACKGROUND OF THE INVENTION

1. Field of the Invention

The present invention relates generally to exhaust systems for internal combustion engines. More specifically, the present invention relates to inserts for engine exhaust systems for reducing or otherwise baffling or modifying the sound of the exhaust when the engine is in operation. The inserts may also serve as spark arrestors as well.

2. Description of the Related Art

While virtually all automobiles and trucks come equipped at the time of purchase with adequate sound suppression systems for their engines, this is not necessarily the case with many vehicles intended for off-road use. Personal watercraft and various racing and competition vehicles, wheeled or otherwise, may have relatively loud engine exhaust systems in order to reduce restrictive back pressure in the exhaust. In other cases, vehicle owners have modified the exhaust systems of their automobiles, motorcycles, etc. in an attempt to provide a distinctive sound, or perhaps a distinctive appearance for the exhaust system where it is exposed, as is the case with motorcycles.

Perhaps the easiest way of reducing the back pressure in an exhaust system is to construct a system wherein all of the pipes are completely open, i.e., without internal restriction. Many motorcycle owners and operators have attempted operation with such open exhaust systems, and in fact, the sound output of such systems may be legal and/or acceptable in some conditions, particularly with smaller engines and where the type of vehicle is not heavily regulated insofar as its exhaust emissions (sound and otherwise) are concerned.

While this may be acceptable in some circumstances, the resulting noise level is certainly not acceptable in most operating environments. One problem with such modification is that the resulting modified exhaust system may produce a sound level that exceeds the maximum permitted by law for the jurisdiction and/or type of vehicle. This may be true of racing, competition, and off road vehicles as well, depending upon the environment of use, rules of the sanctioning body, and perhaps other factors. When this occurs, the owner or operator of the vehicle must find some way to reduce the sound output of the exhaust system.

Various techniques have been developed in the past for reducing the sound level output of an internal combustion engine exhaust system, e.g., stuffing steel wool and/or glass fiber packing into the pipe or tube, etc. Such a modification is easily accomplished, but the resulting back pressure in the system is likely excessive. Other than the above well-known technique, the present inventor is only aware of exhaust systems and components (replacement mufflers, etc.) that incorporate rigid internal baffling installed at the time of manufacture. The end user cannot easily modify such an exhaust system by removing and/or replacing one or more inserts therein to affect the sound output of the exhaust system.

An example of such a manufactured exhaust system is disclosed in Japanese Patent No. 6-323,136 published on Nov. 22, 1994. This reference describes (according to the drawings and English abstract) an internal supporting structure for a concentrically installed rigid tube and catalytic converter assembly within an outer exhaust pipe. The assembly is permanently installed within the outer pipe at the time of manufacture of the device, with no means provided for inserting the internal assembly within an existing pipe having a closed wall, particularly in the case of a curved pipe.

None of the above inventions and patents, taken either singly or in combination, is seen to describe the instant invention as claimed. Thus, inserts for engine exhaust systems solving the aforementioned problems is desired.

SUMMARY OF THE INVENTION

The inserts for engine exhaust systems comprise various embodiments of a flexible conical mesh or screen formed of fibers (e.g., metal, ceramic, glass fiber, etc.) or rovings of metal bands that are interlaced (e.g. 304 stainless steel) capable of resisting high temperatures. Each conical insert is provided with a rigid circumferential attachment ring at its larger diameter end, with the ring having an outer diameter closely conforming to the inner diameter of the pipe. The inserts may comprise a single frustoconical unit with the smaller diameter end being supported by a rigid ring, which is, in turn, braced within the pipe, or which has an unsupported smaller diameter end. Alternatively, the insert may comprise a pair of opposed frustoconical units having opposed larger diameter ends and joined smaller diameter ends. The attachment and/or support rings may be welded to the metal mesh material of the conical component, or each may comprise a pair of concentric rings crimped together with the mesh captured therebetween. A coiled spring may be installed within the flexible conical mesh to provide some additional rigidity, and/or additional baffling may be provided in the form of a relatively thin glass fiber batt installed over the outer surface of the mesh.

Each of the various embodiments may be installed within an existing open exhaust pipe, i.e., one not having any internal sound reducing structure therein, by sliding the attachment or support ring into the interior of the pipe and using a flexible tool to work the insert into the pipe to the location desired. The flexibility of the conical mesh portion allows the insert to bend and flex to pass through curved or bent areas of the exhaust pipe without jamming therein. The flexibility of the insert, as well as its sound deadening capacity, can be enhanced by forming the peripheral surface into a bellows-type configuration (VVVVVV). Any practicable number of such inserts, in any practicable configuration, may be installed within a single pipe. When the device is located, it may be anchored in place by securing a screw, rivet, etc. through the wall of the pipe and through the attachment ring of the device within the pipe. The screw may be removed and/or the rivet drilled out for removal of the device at a later date. Alternatively, the device may be permanently installed within the pipe, e.g., by spot welding the attachment ring in place within the pipe. The installed device serves to reduce the exhaust sound emissions of the engine exhaust, and may also serve as a spark arrestor as well.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises an insert for the engine exhaust system of an internal combustion engine, e.g., automobile, truck, motorcycle, boat, personal watercraft, aircraft, stationary generator engine, etc. All such engines include an exhaust system in the form of one or more pipes extending from the exhaust ports of the cylinder head to transfer exhaust gas output to a region clear of the engine and/or vehicle. In many instances, particularly (but not exclusively) in the case of vehicles operated off-road, regulations regarding exhaust system sound level output are relatively loose or even non-existent. In other cases, the owner or operator of the vehicle may wish to install a different type of exhaust system, and must accommodate regulations regarding sound output of the system.

Figure 1:
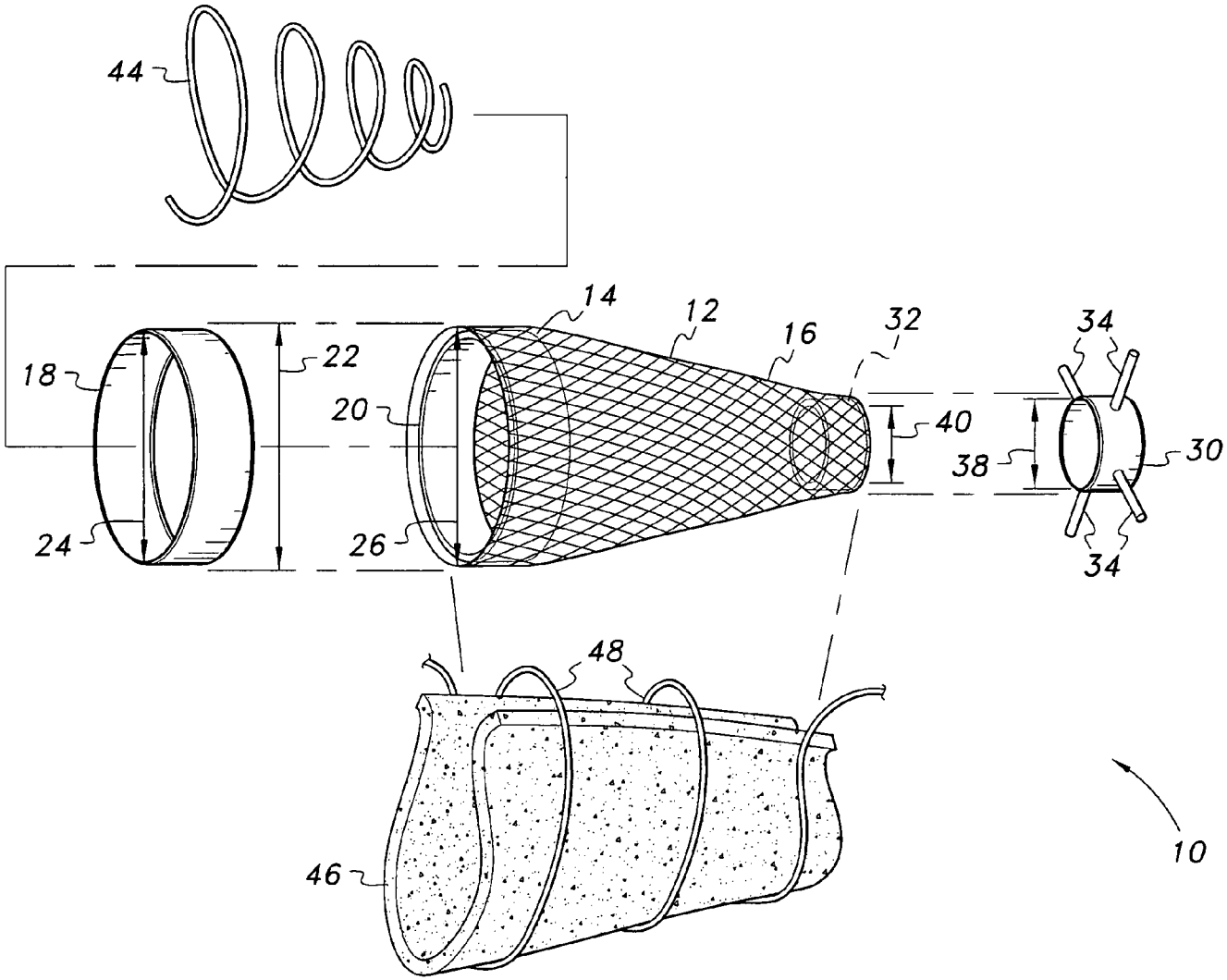
FIG. 1 is an exploded perspective view of a first embodiment of an insert for an engine exhaust system according to the present invention.
Figure 2:
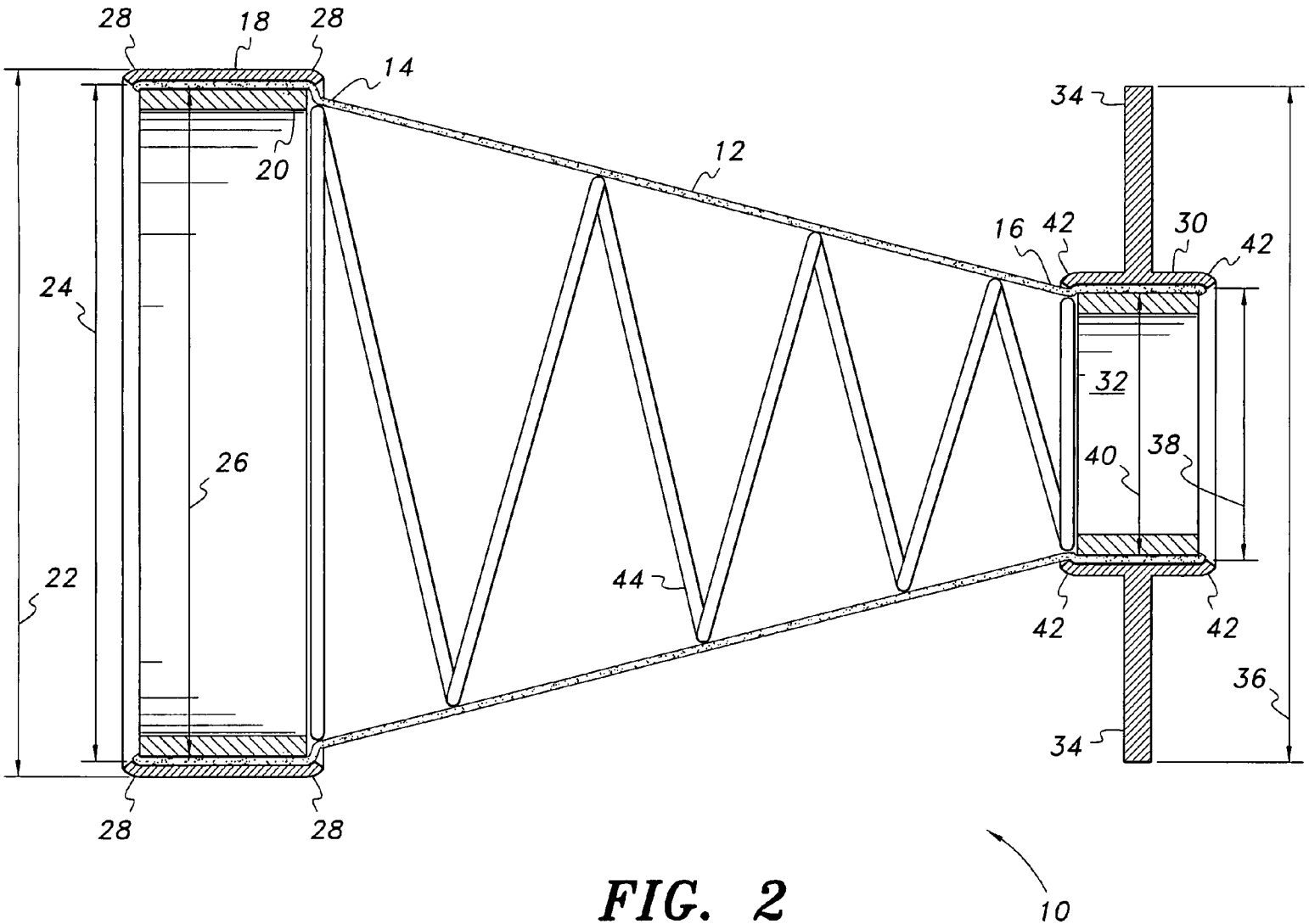
FIG. 2 is a side elevation view in section of the insert embodiment of FIG. 1, the external wrap being omitted.

FIG. 1 of the drawings provides an exploded perspective view of a first embodiment of an insert for an engine exhaust system, designated generally as 10, with FIG. 2 providing a side elevation view in partial section of the insert 10 of FIG. 1 without the optional external fiber batt covering shown in FIG. 1. The exhaust insert 10 of FIGS. 1 and 2 includes a frustoconical mesh component 12 formed of a woven, high temperature resistant material, e.g., corrosion resistant steel (i.e., "stainless" steel), glass or ceramic fiber, etc. Alternatively, a standard steel or other metal may be used, if desired. The material selected for the mesh component should provide sufficient porosity and flow-through to allow exhaust gases to pass therethrough without significant back pressure, and should be sufficiently flexible to allow for installation in a curved pipe by passing the insert 10 through the pipe and any curved portions thereof. A stainless steel braided mesh has been found to work well in testing, but other materials may be used in lieu thereof, as described above.

Figure 3:
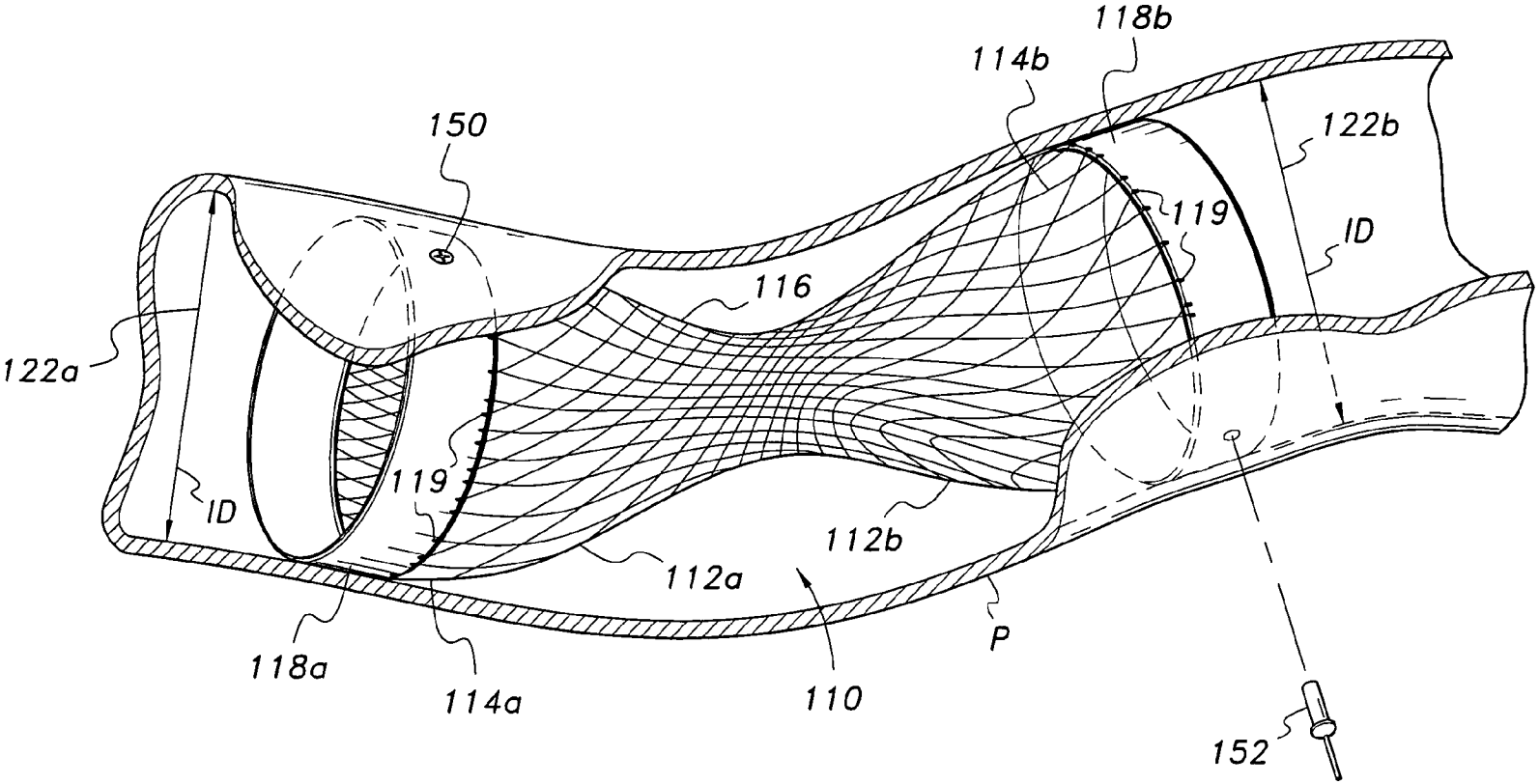
FIG. 3 is a broken away perspective view of a sinusoidal exhaust pipe having a second embodiment of an insert for an engine exhaust system according to the present invention installed therein, showing various details of the insert and its installation.
Figure 4:
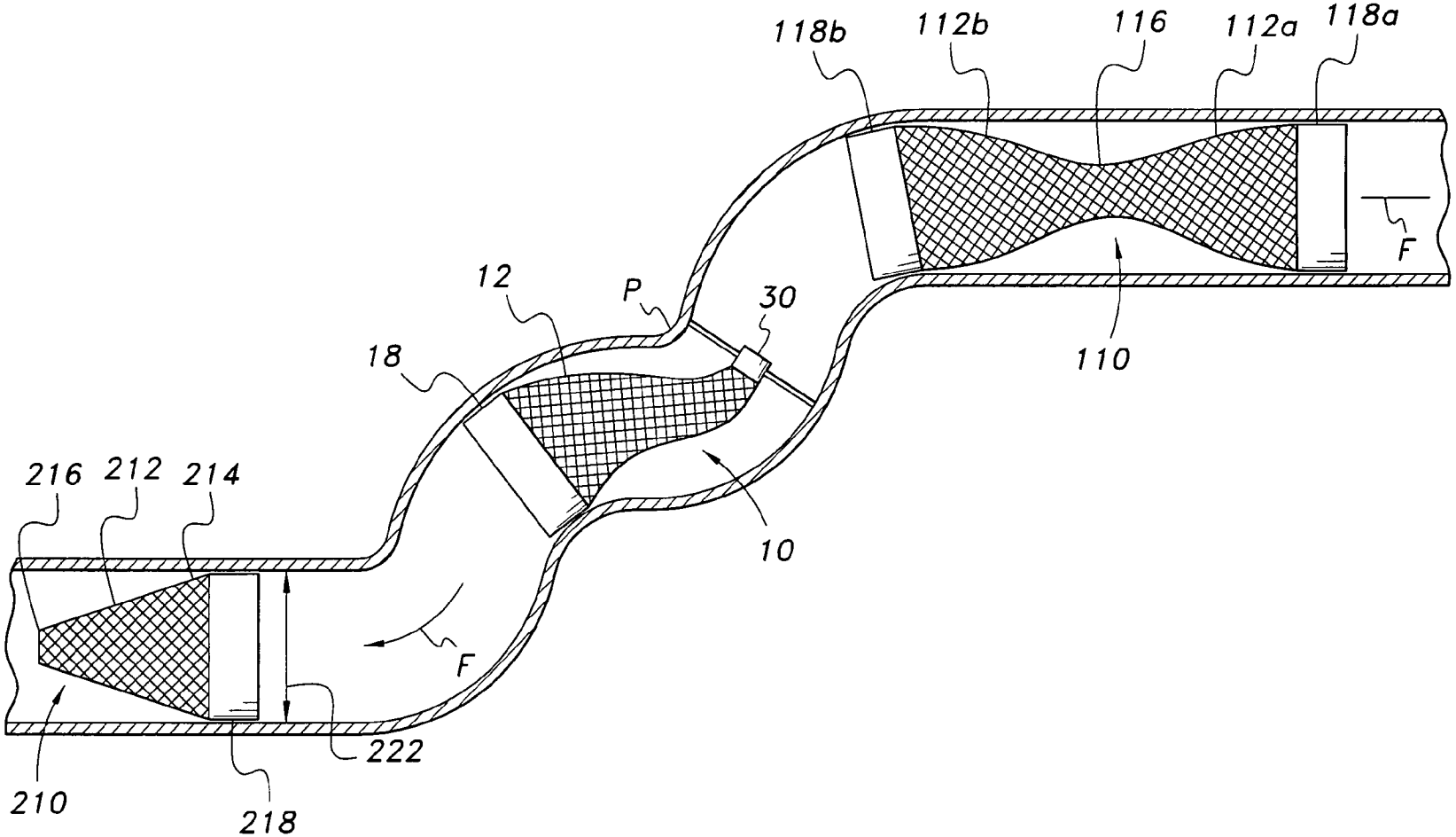
FIG. 4 is a broken away side elevation view of a sinusoidal exhaust pipe having a plurality of different embodiments of inserts for an engine exhaust system according to the present invention installed therein.

The frustoconical mesh component 12 includes a large diameter first end 14 and an opposite second end 16 of smaller diameter than the first end. The two diameters 14 and 16 are selected so that the larger diameter end 14 fits closely within the internal diameter of the exhaust pipe, as shown in FIGS. 3 and 4 and discussed further below, with the smaller diameter end 16 being formed with a diameter small enough to develop the desired level of sound restriction in the exhaust output.

The larger diameter end 14 of the frustoconical mesh component 12 should retain its open shape to conform closely to the internal diameter of the exhaust pipe in order to avoid significant bypass of exhaust past the outer edge or surface of the mesh. This is accomplished by means of an attachment ring component secured to or about the larger diameter end 14 of the mesh component. In the embodiment 10 of FIGS. 1 and 2, the attachment ring component comprises concentric outer and inner attachment rings 18 and 20, which capture the larger diameter end 14 of the mesh component 12 therebetween. The larger diameter outer attachment ring 18 has an outer diameter 22 configured to fit closely within the inner diameter of the exhaust pipe in which the device is to be installed, and an inner diameter 24 configured to fit about the open end 14 of the mesh component 12. The inner attachment ring 20 has an outer diameter 26 configured to fit closely within the open end 14 of the mesh component 12, with the inner diameter of the inner ring 20 being of sufficient size to avoid undue restriction of exhaust gases passing therethrough. The inner attachment ring 20 is first installed within the larger diameter end 14 of the mesh component 12, with the outer attachment ring 18 being placed concentrically thereover. The opposite edges of the outer ring 18 are then secured about the corresponding edges of the inner ring 20, and the mesh material 12 is sandwiched therebetween by crimps 28, as shown in FIG. 2.

The exhaust system insert 10 of FIGS. 1 and 2 also includes a support ring component at the smaller diameter end 16 thereof. The small diameter end support ring component assembly is similar to the large diameter support ring component assembly discussed above, having concentric outer and inner attachment rings 30 and 32, which capture the smaller diameter end 16 of the mesh component 12 therebetween. The outer attachment ring 30 should not define an unduly large thickness. The small diameter end outer attachment ring 30 may have radially disposed brace arms 34 extending therefrom, with the lengths of the arms 34 being dimensioned to have a span or diameter 36 (shown in FIG. 2) to fit closely within the inner diameter of the exhaust pipe within which the device 10 is to be installed. These brace arms 34 thus hold the small diameter end support ring component or assembly concentrically within the exhaust pipe. The inner diameter 38 of the small end outer ring 30 is configured to fit about the smaller diameter end 16 of the mesh component 12. The inner attachment ring 32 of the small diameter end has an outer diameter 40 configured to fit closely within the smaller diameter end of the mesh component. The inner attachment ring 32 is first installed within the smaller diameter end 14 of the mesh component, with the outer attachment ring 30 being placed concentrically thereover. The opposite edges of the outer ring 30 are then secured about the corresponding edges of the inner ring 32, and the mesh material 12 is sandwiched therebetween by crimps 42, as shown in FIG. 2.

Additional support may be provided for the exhaust insert 10 by installing a spring 44 therein, if desired, generally as shown in FIGS. 1 and 2. The spring 44 preferably comprises a tapered coil spring, i.e., having a frustoconical external shape, dimensioned to fit closely within the frustoconical shape of the mesh component 12 and having opposite large and small diameter ends closely matching the large and small diameter ring components at each end of the mesh component. The spring 44 provides additional support for the mesh component 12, holding it in its desired conical configuration. The spring 44 is preferably formed of a corrosion resistant steel, but other materials may be used as desired.

FIG. 1 also illustrates an additional optional glass fiber batt 46, which may be installed about the exterior of the frustoconical mesh 12, if desired. The batt 46 is formed of material similar to that used in thermal insulation, but is considerably thinner (e.g., one-half inch, more or less) in order to fit within the exhaust system. The batt 46 is cut to conform to the frustoconical shape of the exterior of the mesh 12, and is secured in place by wrapping, sewing, or otherwise attaching a steel wire strand 48 (or other material having sufficient heat resistant properties) about the batt 46 to secure it to the underlying mesh 12 material. It will be seen that the exhaust insert 10 of FIG. 2 is identical to that of FIG. 1, except for the optional batt shown in FIG. 1.

FIG. 3 of the drawings provides an illustration of a second embodiment of an exhaust system insert, designated generally as 110 in the drawings. The insert 110 of FIG. 3 comprises a longitudinally symmetrical device having opposed mirror image portions. The insert 110 includes first and second frustoconical sections 112*a* and 112*b*, respectively, which are formed of any suitable porous mesh material (e.g., stainless or standard steel screen or mesh, glass fiber, ceramic mesh, etc.). Each section 112*a* and 112*b* includes a large diameter first end 114*a* and 114*b* and an opposite second end 116 of smaller diameter than the first end. It will be seen that the two frustoconical sections 112*a* and 112*b* of the mesh component form a continuous length extending between their opposite ends 114*a* and 114*b*, with the smaller diameter end 116 of each portion 112*a* and 112*b* being common between the two portions 112*a* and 112*b*. The two large diameter ends 114*a* and 114*b* are selected so that their outer diameters fit closely within the internal diameter ID of the exhaust pipe P, as shown in FIGS. 3 and 4.

The exhaust insert 110 of FIG. 3 includes substantially identical first and second attachment ring components 118*a* and 118*b* permanently secured to the respective ends 114*a* and 114*b* of the mesh portions 112*a* and 112*b* of the device. These attachment ring components 118*a* and 118*b* may comprise two concentric rings capturing the end of the mesh component 112*a* and 112*b* therebetween, as in the ring assemblies 18 and 20 of the embodiment 10 of FIG. 1, or may alternatively comprise single rings attached to the mesh by weldments 119 when a metal material is used to form the mesh portion of the insert 110. Conversely, the ring components of the embodiment 10 of FIG. 1 may comprise single rings of appropriate diameter at each end of the mesh and welded thereto, if so desired. However, installation of support rings comprising two concentric rings capturing the mesh material therebetween is preferred, as the welding of the fine strands of the mesh to the support ring is a tedious and time consuming operation. In any event, the outer diameters 122*a* and 122*b* of the two rings or ring assemblies 118*a* and 118*b* are dimensioned to fit closely within the internal diameter ID of the pipe P, as shown in FIGS. 3 and 4 of the drawings.

The exhaust system insert 110 of FIG. 3 (and other embodiments of the device) is secured within the exhaust pipe P by appropriate fasteners, e.g., a screw or screws 150 driven through concentric attachment passages in the outer wall of the exhaust pipe P and the corresponding attachment ring, e.g., the first ring 118*a*, or a rivet 152 installed in concentric attachment passages, as shown for the second ring 118*b* of FIG. 3. Preferably, "blind" rivets are used, i.e., rivets that are set solely by the use of an external tool applied to the manufactured head. Thus, the insert 110 (and others installed in a similar manner) may be removed if so desired, by removing the screw(s) 150 and/or drilling out the rivet(s) 152. Alternatively, the exhaust insert 110 (and others) may be permanently installed within the pipe P by spot welding the attachment rings 118*a*, 118*b* (or others) through the wall of the pipe P.

FIG. 4 of the drawings provides a cross-sectional view of an exemplary installation of various different embodiments of the exhaust system insert in a single exhaust pipe P. A person installing the insert, or inserts, may not wish to install one of each of the embodiments shown in FIG. 4 within a single pipe P. However, FIG. 4 provides an illustration of the installation of each type or embodiment of the insert in a single drawing for convenience in illustration. The inserts 10 and 110, shown respectively in the approximate center and toward the right end of the pipe P in FIG. 4, have been discussed in detail further above. However, FIG. 4 also illustrates a third embodiment of the insert, designated as insert 210. The insert 210 is configured much like the insert 10 of FIGS. 1 and 2, having a single frustoconical portion 212 of flexible porous mesh material with a large diameter end 214 and an opposite smaller diameter end 216. As in the case of the other exhaust system inserts 10 and 110 discussed further above, the attachment ring 218 of the insert 210 has an outer diameter 222 closely fitting within the internal diameter ID of the exhaust pipe P in order to preclude significant exhaust flow between the outer surface of the ring 218 and the inner surface of the pipe P. The attachment ring component 218 of the embodiment 210 of FIG. 4 preferably comprises a pair of concentric rings capturing the larger diameter end 214 of the mesh 212 therebetween, as in the ring assembly 18 and 20 of the embodiment 10 of FIGS. 1 and 2, or may alternatively comprise a single ring with the metal mesh 212 welded thereto, as in the embodiment 110 of FIG. 3.

The exhaust system insert 210 of FIG. 4 differs from the insert 10 of FIGS. 1, 2, and 3 in that the insert 210 does not have any form of support ring at its smaller diameter end 216. Thus, the smaller diameter end 216 is free to "float" within the interior of the pipe P. It will be noted that the exhaust flow in such an installation is from right to left through the pipe P, as indicated by the exhaust flow arrows F in FIG. 3. Thus, the inlet end of the insert 210 is anchored within the pipe P by the larger diameter attachment ring 218, while the smaller diameter outlet end 216 is free to blow downstream in the exhaust system, somewhat in the manner of an aviation windsock used to indicate the direction of the wind at airports. However, it will be noted that the other embodiments 10 and 210 may be installed without concern for the direction of exhaust gas flow through the pipe P, as each of their ends are anchored or braced within the pipe.

Figure 5:
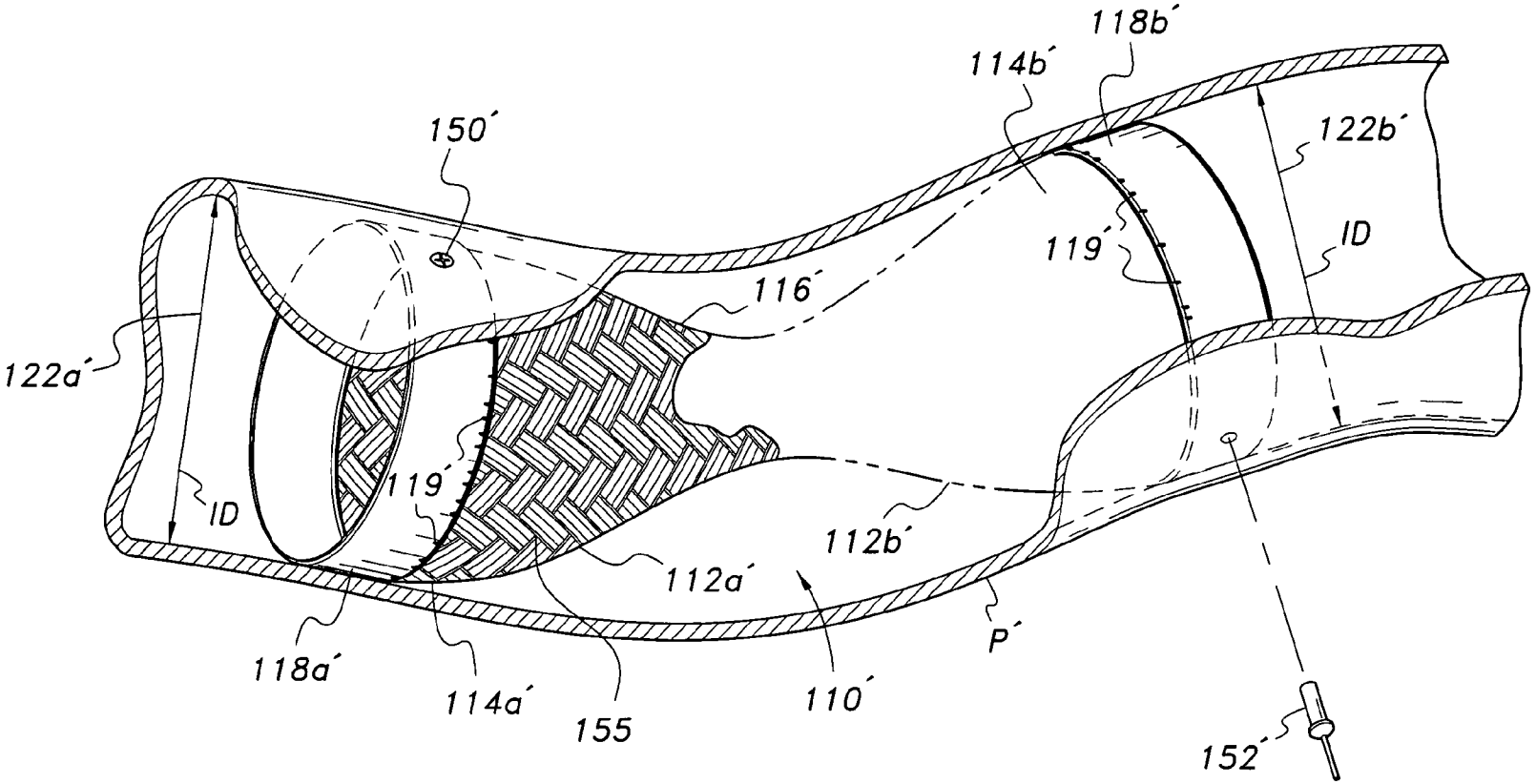
FIG. 5 is a broken away perspective view of a sinusoidal exhaust pipe having a third embodiment of an insert for an engine exhaust system according to the present invention installed therein, showing various details of the insert and its installation.

The exhaust insert 110' of FIG. 5 includes substantially identical structure as shown in FIG. 3, with like structure being indicated by a "prime". As seen in FIG. 5, the exhaust insert 110' includes substantially identical first and second attachment ring components 118*a*' and 118*b*' permanently secured to their respective ends 114*a*' and 114*b*' of the interlaced flat roving portions 112*a*' and 112*b*' of the device. These attachment ring components 118*a*' and 118*b*' may comprise two concentric rings capturing the end of the roving component 112*a*' and 112*b*' therebetween, as in the ring assemblies 18 and 20 of the embodiment 10 of FIG. 1, or may alternatively comprise single rings attached to the rovings by weldments 119' when a metal material is used to form the roving portion of the insert 110'. However, installation of support rings comprising two concentric rings capturing the roving material therebetween is preferred, as the welding of the rovings to the support ring is a tedious and time consuming operation. In any event, the outer diameters 122*a*' and 122*b*' of the two rings or ring assemblies 118*a*' and 118*b*' are dimensioned to fit closely within the internal diameter ID of the pipe P, as shown in FIGS. 3, 4, and 5 of the drawings.

The exhaust system insert 110' of FIG. 5 (and other embodiments of the device) is secured within the exhaust pipe P' by appropriate fasteners, e.g., a screw or screws 150' driven through concentric attachment passages in the outer wall of the exhaust pipe P' and the corresponding attachment ring, e.g., the first ring 118*a*', or a rivet 152' installed in concentric attachment passages, as shown for the second ring 118*b*' of FIG. 5. Preferably, "blind" rivets are used, i.e., rivets that are set solely by the use of an external tool applied to the manufactured head. Thus, the insert 110' (and others installed in a similar manner) may be removed, if so desired, by removing the screw(s) 150' and/or drilling out the rivet(s) 152'. Alternatively, the exhaust insert 110' (and others) may be permanently installed within the pipe P' by spot welding the attachment rings 118*a*', 118*b*' (or others) through the wall of the pipe P'.

As depicted in FIG. 5, the exhaust insert 110' is constituted by a tubular braid or interlacing of bundles of filaments, wires, or multifilament strands or ribbons of metal, for example, 304 stainless steel. The rovings in this embodiment are composed of an interlacement of flat rovings helically wound about the axis of the insert, wherein each flat roving comprises in a combined manner a plurality of strands, each strand having multiple filaments side-by-side. The number of bundles or flat rovings depends on the process or braiding machine used. In addition, the number of wires in each flat roving, the diameter and strength of the wires, as well as the braid angle or angle of interlacement are chosen as a function of the final performance characteristics expected of the insert.

Figure 6:
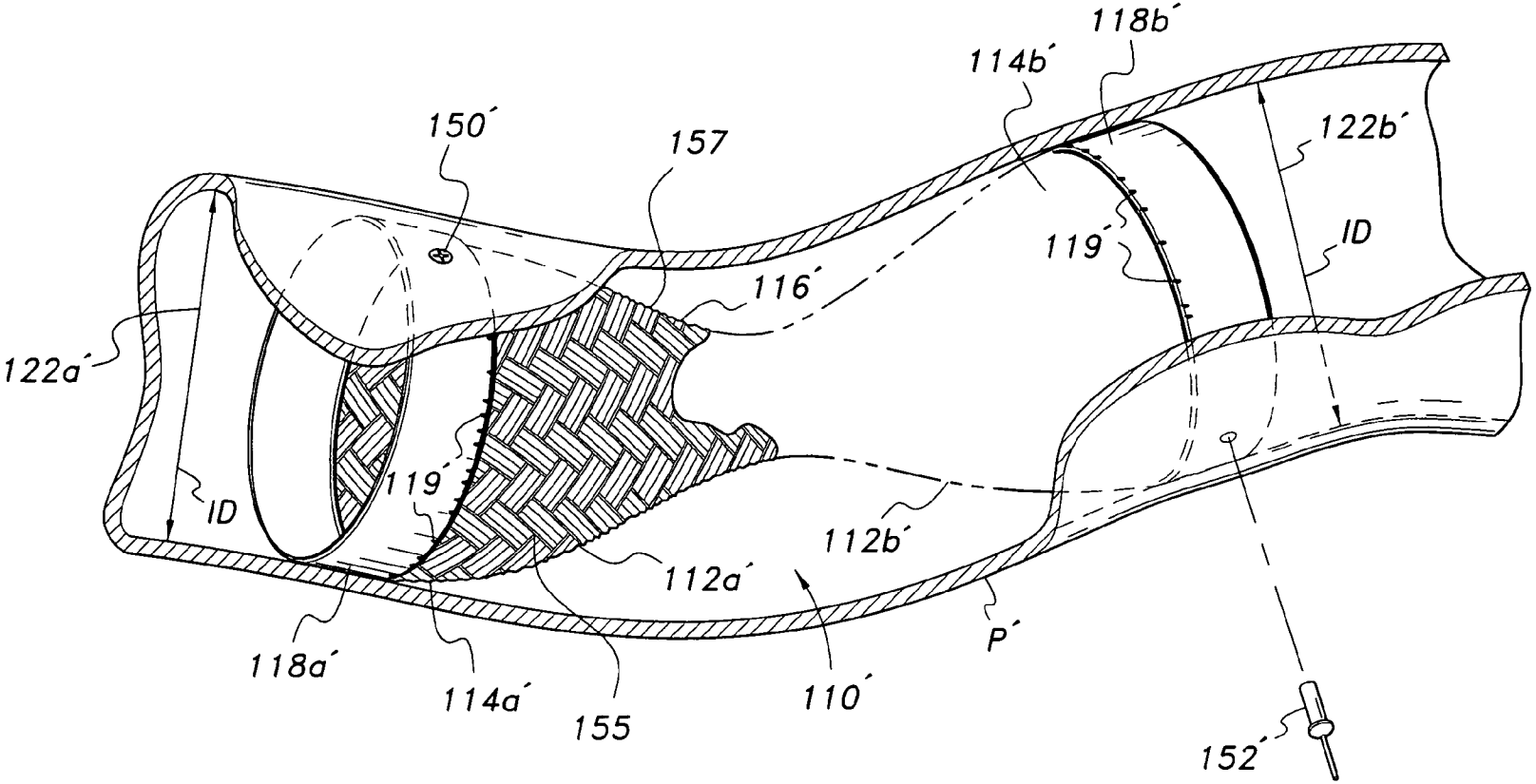
FIG. 6 is a broken away perspective view of a sinusoidal exhaust pipe having a fourth embodiment of an insert for an engine exhaust system according to the present invention installed therein, showing various details of the insert and its installation.

The rovings form a continuous outer surface from the large diameters 114*a*' and 114*b*' through the smaller diameters 116'. Additionally, the interlacing of the rovings is designed to leave spaces or pores 155 therebetween in order to ensure that the exhaust insert has the requisite flexibility and bending ability to conform to the configuration of the exhaust pipe P'. The spaces also ensure that the exhaust gases can "breathe" or escape therethrough. Although the rovings are depicted as wires or strands, it is recognized that the interlacing bands may be metal tapes or combinations of filamentary rovings and metal tapes. Although FIG. 5 depicts the outer surface of the exhaust baffle as a continuous surface, it is recognized that the outer surface could be configured in a bellows-type arrangement 157. This type of peripheral configuration is shown in FIG. 6, wherein all other components are identical to that shown in FIGS. 3 and 5.

In conclusion, the insert for an engine exhaust system in its various embodiments provides a relatively simple and straightforward means for a person to reduce the sound emissions of an open exhaust system, i.e., an exhaust system not having any internal sound baffling or other internal components. The insert may also serve as a spark arrestor where such devices are required, regardless of any reduction of sound output provided by the device(s).

The insert is particularly well suited for installation in a motorcycle exhaust system, where the exhaust pipes curve or bend downwardly and rearwardly from the cylinder heads of the engine. The insert, with its flexible mesh or roving components, can be inserted into such an open pipe with a suitable tool and pass around curves and bends in the pipe for securing therein. While the insert is particularly well suited for installation in a motorcycle exhaust system, it should be noted that they are not limited to installation within such an exhaust system, but may be adapted to virtually any type of internal combustion engine exhaust system. Accordingly, the insert will be greatly appreciated by those who have occasion to construct custom exhaust systems, and/or modify exhaust systems to produce a required or desired level of sound output.

It is to be understood that the present invention is not limited to the embodiments described above, but encompasses any and all embodiments within the scope of the following claims.

I claim:

1. A flexible insert for an engine exhaust system, the system having at least one exhaust pipe defining an inner diameter and possessing at least one curved portion therealong, the insert comprising:

a first flexible frustoconical section comprising a porous interlacement of flat rovings helically wound about an axis of the insert and having an open large diameter end and an open small diameter end opposite the large diameter;

a second flexible frustoconical section comprising a porous interlacement of flat rovings helically wound about an axis of the insert and having an open large diameter end and an open small diameter end opposite the large diameter, the small diameter ends of the first and second flexible frustoconical sections of rovings being interlaced together in a continuous length, whereby the entire insert is sufficiently flexible to bend and flex through a curved portion of an exhaust pipe;

a first open attachment ring component secured to the large diameter end of the first frustoconical section; and a second open attachment ring component secured to the large diameter end of the second frustoconical section, the first attachment ring component being disposed opposite the second attachment ring component, each of the attachment rings having an outer diameter conforming closely to the inner diameter of the exhaust pipe.

2. The insert for an engine exhaust system according to claim 1, wherein the first and second attachment rings are welded to the rovings.

3. The insert for an engine exhaust system according to claim 1, wherein each roving comprises a plurality of filaments combined together.

4. The insert for an engine exhaust system according to claim 1, wherein each roving comprises a flat metal tape.

5. The insert for an engine exhaust system according to claim 1, wherein said rovings comprise an interlacement combination of filamentary ravings and flat metal tape.

6. The insert for an engine exhaust system according to claim 1, wherein the outer peripheral surface of the first and second frustoconical sections is continuous.

7. The insert for an engine exhaust system according to claim 1, wherein the outer peripheral surface of the first and second frustoconical sections is configured in a bellows-type configuration.

8. A method for attenuating sound in an exhaust system of an internal combustion engine, comprising the steps of:

providing a sound attenuating flexible insert for placement in an exhaust system, the insert comprising:

i) a first flexible frustoconical section comprising a porous interlacement of flat rovings helically wound about an axis of the insert and having an open large diameter end and an open small diameter end opposite the large diameter;

ii) a second flexible frustoconical section comprising a porous interlacement of flat rovings helically wound about an axis of the insert and having an open large diameter end and an open small diameter end opposite the large diameter, the small diameter ends of the first and second flexible frustoconical sections of ravings being interlaced together in a continuous length, whereby the entire insert is sufficiently flexible to bend and flex through a curved portion of an exhaust pipe;

iii) a first open attachment ring component secured to the large diameter end of the first frustoconical section; and iv) a second open attachment ring component secured to the large diameter end of the second frustoconical section, the first attachment ring component being disposed opposite the second attachment ring component, each of the attachment rings having an outer diameter conforming closely to the inner diameter of the exhaust pipe;

placing the insert in an exhaust pipe of the exhaust system so that the entire insert is coaxially disposed inside the pipe; and affixing said first and second rings to the pipe.

9. The method for attenuating sound according to claim 8, further comprising the step of using a tool for flexible conduit to push the insert through bends in the exhaust pipe.

10. The method for attenuating sound according to claim 8, wherein said affixing step comprises welding said rings to the exhaust pipe.

11. The method for attenuating sound according to claim 8, wherein said affixing step comprises the step of fastening said rings to the exhaust pipe with threaded fasteners.

12. The method for attenuating sound according to claim 8, wherein said affixing step comprises the step of fastening said rings to the exhaust pipe with rivets.

13. In combination, a device for attenuating sound in an exhaust system of an internal combustion engine, the system having at least one exhaust pipe defining an inner diameter and possessing at least one curved portion therealong, comprising:

a hollow section of exhaust pipe adapted for connection in the exhaust system of the engine, the hollow section having at least one curved section therein; and a flexible insert coaxially disposed within the exhaust pipe, the flexible insert having:

a first flexible frustoconical section comprising a porous interlacement of flat rovings helically wound about an axis of the insert and having an open large diameter end and an open small diameter end opposite the large diameter;

a second flexible frustoconical section comprising a porous interlacement of flat rovings helically wound about an axis of the insert and having an open large diameter end and an open small diameter end opposite the large diameter, the small diameter ends of the first and second flexible frustoconical sections of rovings being interlaced together in a continuous length, whereby the entire insert is sufficiently flexible to bend and flex through the curved portion of an exhaust pipe;

a first open attachment ring component secured to the large diameter end of the first frustoconical section; and a second open attachment ring component secured to the large diameter end of the second frustoconical section, the first attachment ring component being disposed opposite the second attachment ring component, each of the attachment rings having an outer diameter conforming closely to the inner diameter of the exhaust pipe.

14. The device for attenuating sound according to claim 13, wherein said first and second rings are affixed to said exhaust pipe.

15. The device for attenuating sound according to claim 13, wherein said corrosion resistant wire comprises stainless steel wire.

16. The device for attenuating sound according to claim 13, wherein said central portion gradually tapers in diameter from the middle of the tube towards the inlet end and the outward end, forming frustoconical inlet and outlet ends of the tube.

17. The device for attenuating sound according to claim 13, wherein each said strand comprises multiple filaments extending parallel to each other in a flat ribbon.

* * * * *